United States Patent [19]

Dobrjanskyj

[11] 4,170,951

[45] Oct. 16, 1979

[54] SKIPPED STITCH DETECTION SYSTEM

[75] Inventor: Leo Dobrjanskyj, Flushing, N.Y.

[73] Assignee: The Singer Company, New York, N.Y.

[21] Appl. No.: 969,614

[22] Filed: Dec. 14, 1978

[51] Int. Cl.[2] ..... B65H 63/02

[52] U.S. Cl. ..... 112/278; 200/61.18

[58] Field of Search ..... 112/278, 273, 272; 200/61.18, 61.13, 61.14

[56] References Cited

U.S. PATENT DOCUMENTS

| | | | |
|---|---|---|---|
| 3,425,375 | 2/1969 | Jacobs et al. | 112/278 |
| 3,587,497 | 6/1971 | Beazley | 112/278 |

FOREIGN PATENT DOCUMENTS

| | | | |
|---|---|---|---|
| 2606035 | 8/1977 | Fed. Rep. of Germany | 112/278 |

*Primary Examiner*—H. Hampton Hunter

*Attorney, Agent, or Firm*—David L. Davis; Robert E. Smith; Edward L. Bell

[57] ABSTRACT

A skipped stitch detection system for a sewing machine is provided with a strain gage mounted on the slack thread regulator. The strain gage is connected in a Wheatstone bridge configuration. An amplified output from the Wheatstone bridge and timing signals from the sewing machine are provided to a microprocessor which analyzes the thread tension profile to detect the occurrence of a skipped stitch.

7 Claims, 7 Drawing Figures

TENSION
0°
99°
102°
135°
180°
360°
ARMSHAFT ROTATION

TENSION
0°
99°
102°
135°
180°
360°
ARMSHAFT ROTATION

UTILIZATION CIRCUIT
45
71
MICROPROCESSOR
67
29,31
69
A/D CONVERTER
65
TIMING SENSORS
LOW PASS FILTER
64
59
61
53
63
62
55
51
47
49
39
41
57

SKIPPED STITCH DETECTION SYSTEM

BACKGROUND OF THE INVENTION

This invention relates to sewing machines and, more particularly, to a system for use in a sewing machine to automatically detect a skipped stitch.

In the formation of a lockstitch by a sewing machine, thread from an upper supply is projected by the sewing machine needle through the fabric, or other material being sewn, in the form of a small loop. A loop taker mechanism, underneath the material to be sewn, engages the loop projected by the needle and carries the loop around a lower thread supply held on a bobbin. After the needle is withdrawn from the material being sewn, a take up mechanism pulls the upper thread to set the stitch.

In a sewing machine of the aforedescribed type, occasionally the needle thread loop is missed by the loop taker and in such case the needle thread is not carried by the loop taker around the lower thread supply. In such case, a lockstitch is not formed. This condition is known as a skipped stitch. Under high speed sewing conditions, the machine operator typically will be entirely unaware that a stitch has been skipped, and the skip is not readily evident in the fabric itself, except by a painstaking stitch-by-stitch inspection, which of course is highly impractical. Accordingly, the fabric segment with the undetected skipped stitch in it typically continues to go through its normal production sequence, in which it is incorporated into a finished product. This skipped stitch causes a weakness in the seam because there is one less stitch holding the seam together. Further, the extra length of thread between stitches in the region of the skipped stitch is more likely to be snagged and broken, with the consequent opening of the seam. If the skipped stitch is not immediately detected, the defective part will go through the entire production sequence and have considerable value added thereto and associated therewith. For example, the fabric having a defective seam may become part of the upholstery of an automobile or an expensive piece of furniture. During service, the defective seam may prematurely give way and open up, resulting in a possibly defective automobile or article of furniture. Thus, by reason of the lack of detection of a single skipped stitch, a manufacturer may be exposed to a substantial expense involved in the replacement or repair of a much larger article.

It is therefore an object of the present invention to provide an arrangement whereby a skipped stitch is automatically detected as it occurs.

SUMMARY OF THE INVENTION

The foregoing and additional objects are attained in accordance with the principles of this invention in a sewing machine having a support for work fabric to be stitched, cyclically operating stitch forming instrumentalities including a thread carrying needle adapted for endwise reciprocation to penetrate the fabric, a supply of thread for the needle, and a thread handling system including a tension control system for the thread disposed intermediate the supply and the needle, by providing a skipped stitch detection system comprising sensing means disposed intermediate the tension control means and the needle and responsive to thread tension for supplying a tension signal, the instantaneous value of which corresponds to the thread tension at the sensing means position, the value of the tension signal having a first cyclic profile corresponding to a normal stitch and a second cyclic profile corresponding to a skipped stitch, timing means for providing timing signals at predetermined times relative to the operating cycle of the stitch forming instrumentalities, means responsive to the timing signals for defining examination windows for the tension signal, and means for examining the tension signal within the examination windows and responsive to values of the tension signal corresponding to the second cyclic profile for executing a control function.

DESCRIPTION OF THE DRAWINGS

The foregoing will be more readily apparent upon reading the following description in conjunction with the drawings in which.

DETAILED DESCRIPTION

Figure 1:
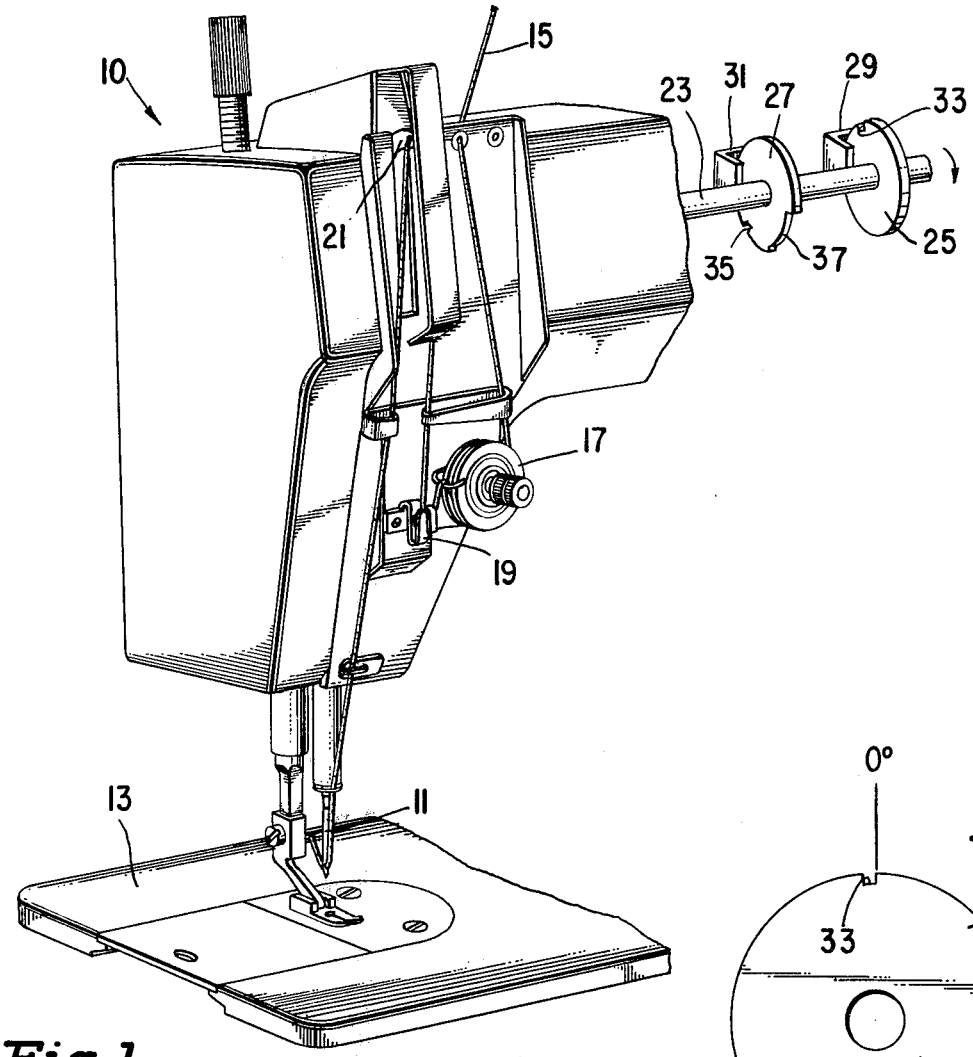
FIG. 1 depicts a portion of a sewing machine in which an arrangement according to the principles of this invention may be incorporated.

Referring now to the drawing, and in particular to FIG. 1, depicted therein is a sewing machine of the lock stitch type in which an arrangement constructed in accordance with the principles of this invention is incorporated. The sewing machine, designated generally by the reference numeral 10, includes a thread carrying needle 11 adapted for endwise reciprocation in a conventional manner well known in the art to penetrate work fabric (not shown) supported on a work surface 13. A thread 15 extends from a supply therefore (not shown) through a tension control mechanism 17, past a slack thread regulator 19, through an aperture in a take up lever 21, and through the eye of the needle 11. Although not shown in the drawing, disposed beneath the work supporting surface 13 is a lower thread supply on a bobbin and a loop taker mechanism which operates in a conventional manner to engage the loop projected by the needle 11 after it penetrates the work fabric. The loop taker operates to carry the loop around the lower thread supply held on the bobbin. After the needle 11 is withdrawn from the work fabric, the take up lever 21 pulls the upper thread 15 to set the stitch. The tension control mechanism 17 is adjustable to control the tension of the upper thread during the stitch setting portion of the aforedescribed operation. The operation of the stitch forming instrumentalities in the formation of a stitch in the manner described above is cyclic in nature. For purposes of the following discussion, the cycle will be defined as comprising 360° with the needle bottom dead center position corresponding to 0° and 360°.

The cyclic operation of the stitch forming instrumentalities is controlled by rotation of the arm shaft 23 in a conventional manner well known in the art. The arm shaft 23 is operatively connected to a main drive motor (not shown). For purposes of the following discussion, the arm shaft 23 will be considered to have mounted thereon a first disc 25 and a second disc 27. The discs 25 and 27 are timing discs and cooperate with respective optoelectronic packages 29 and 31 to provide signals corresponding to predetermined points in the operating cycle. Although shown as being mounted on the arm shaft 23, the discs 25 and 27 could just as well be mounted on the bed shaft (not shown) disposed beneath the work supporting surface 13.

Figure 1A:
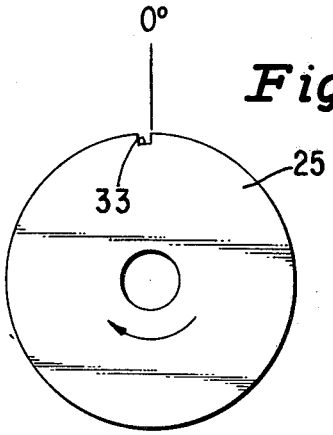
FIGS. 1A and 1B depict illustrative timing discs which may be utilized in the arrangement of FIG. 1.

FIG. 1A shows the timing disc 25 which includes a single slit 33 which is utilized to define the 0° position within the stitch forming cycle. In a manner well known in the art, the optoelectronic package 29 straddles the disc 25 and has on one side thereof a source of light, for example, a light emitting diode, and on the other side thereof has a light sensitive device, for example, a phototransistor. Therefore, a signal is provided from the optoelectronic package 29 only when the slit 33 passes between the light source and the light sensitive device.

Figure 1B:
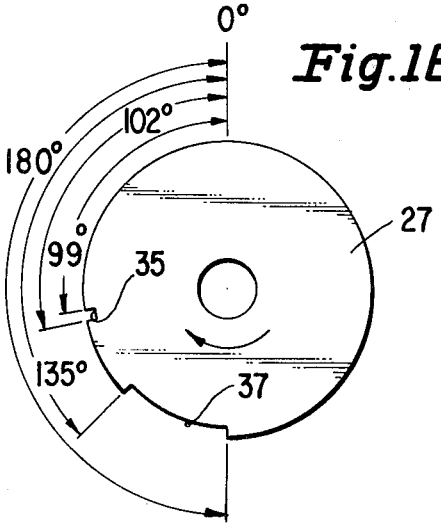

FIG. 1B shows the timing disc 27 which has two slits 35 and 37 therein. Relative to the 0° point in the operating cycle, the slit 35 extends from 99° to 102° and the slit 37 extends from 135° to 180°. As was described above for the optoelectronic package 29, the optoelectronic package 31 straddles the timing disc 27 and provides signals when the slits 35 and 37 pass thereby.

Although the foregoing description has been of timing discs utilizing optical sensing devices, it is apparent that other timing arrangements may be utilized. For example, a magnetic sensing device can be utilized or alternatively an electromechanical sensing device such as a cam and switch combination may likewise be utilized. This invention is not intended to be limited to the specific timing devices shown herein.

Figure 2B:
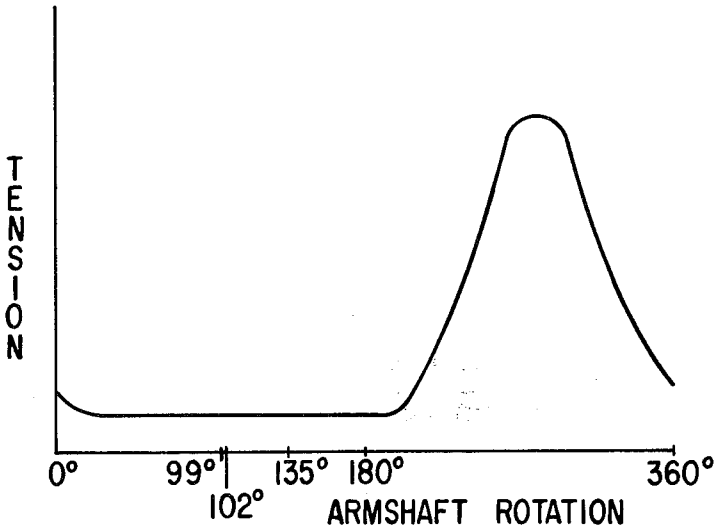
FIG. 2A depicts the upper thread tension profile for a normal stitch and FIG. 2B depicts the upper thread tension profile for a skipped stitch.
Figure 2A:
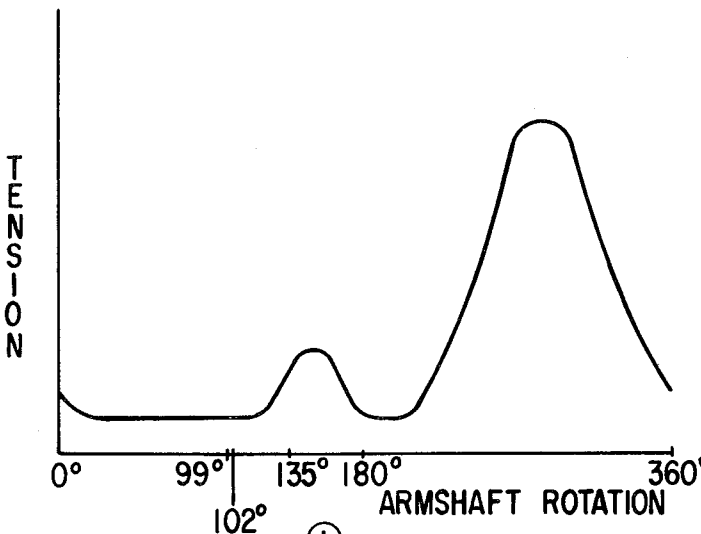

Referring now to FIG. 2A, shown therein is a profile (not to scale) of the tension of the upper thread 15, measured at the slack thread regulator 19, as a function of the rotation of the arm shaft 23, measured in degrees, for a normal stitch. The thread tension is normally low, but exhibits two peaks. The first, and smaller, peak occurs when the loop taker mechanism, underneath the work supporting surface 13, engages the loop projected by the needle 11 and carries the loop around the lower thread supply held on the bobbin. The magnitude of the first peak may vary from about 30 to about 150 grams. The second tension peak, and typically the larger of the two, comes about when the take up lever 21 pulls on the thread 15 in order to set the stitch. The upper magnitude of the tension is set by the tension control mechanism 17 and may vary in excess of about 80 grams.

Referring to FIG. 2B, shown therein is the tension profile (not to scale) of the upper thread 15 in the case of the skipped stitch. In this case, since the loop taker has missed the loop and the loop is not carried about the lower thread supply, the thread tension is low except for the peak which occurs when the take up lever 21 moves upward in an attempt to set the nonexistent stitch.

Figure 3:
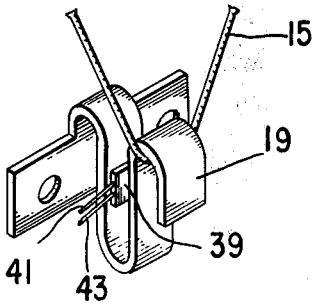
FIG. 3 shows an illustrative thread tension sensor assembly.

Referring now to FIG. 3, shown therein is an enlarged view of the slack thread regulator 19 showing the placement of a strain gage 39 thereon for use as a thread tension sensor. A pair of wires 41, 43, extend from the strain gage 39 to appropriate circuitry which will be described in full detail hereinafter. As is well known, a strain gage is a transducing element which exhibits a change in its electrical resistance when subjected to changes in strain. With the strain gage 39 mounted as shown in FIG. 3, increased tension on the thread 15 will cause a corresponding compression of the strain gage 39. If the strain gage were mounted on the back side of the slack thread regulator directly opposite the position shown in FIG. 3, increased thread tension would result in the strain gage being subjected to increased tension. In any event, its electrical resistance would change in a predictable manner.

Figure 4:
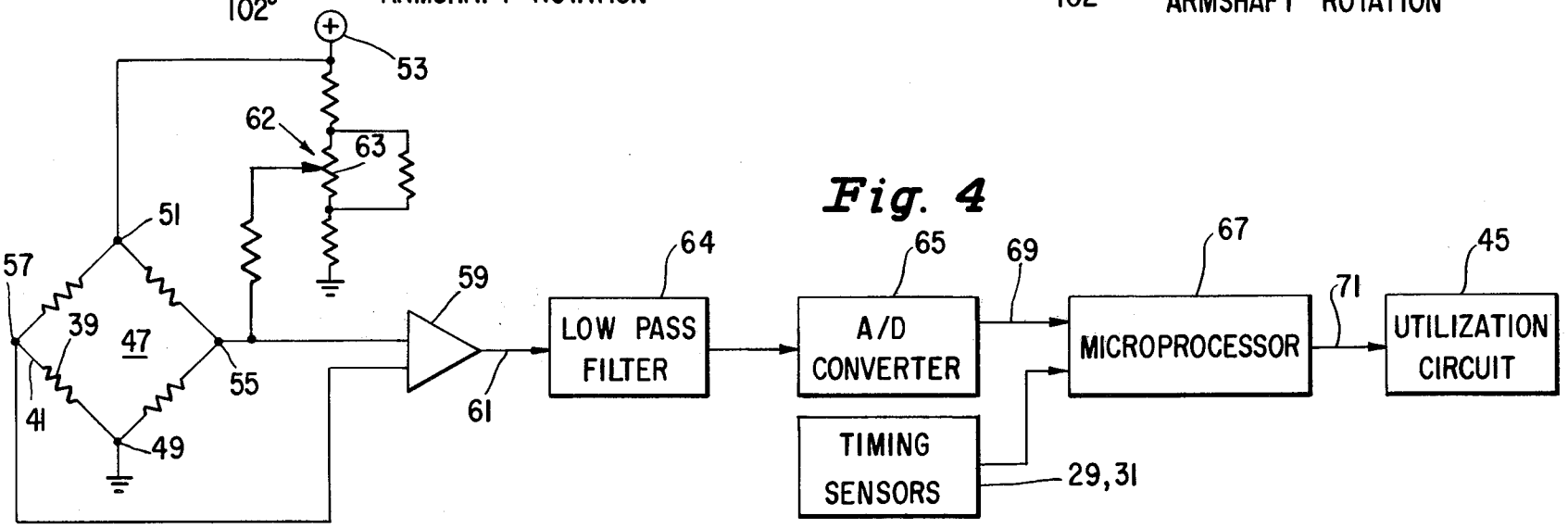
FIG. 4 is a block schematic diagram of circuitry constructed in accordance with the principles of this invention for recognizing and signaling the occurence of a skipped stitch.

Referring now to FIG. 4, shown therein is a block schematic diagram of circuitry constructed in accordance with the principles of this invention and responsive to detection of a skipped stitch for providing a signal to a utilization circuit 45. The strain gage 39 is shown as being connected in one arm of a Wheatstone bridge 47. Although only a single strain gage 39 is shown, it is known that four strain gages, one in each arm, can be connected to form the Wheatstone bridge 47. In such case, two of the strain gages would be positioned as is strain gage 39 on the slack thread regulator 19 and would be subjected to increased compression as the thread tension increases and the other two would be mounted on the slack thread regulator 19 in positions where they would be subjected to increased tension as the thread tension increases. In such case, the strain gages subject to compression would be opposed to each other in the bridge 47 and the strain gages subject to tension would be opposed to each other in the bridge 47. Such an arrangement provides increased sensitivity.

As shown in FIG. 4, the node 49 of the bridge 47 is connected to ground and the node 51 of the bridge 47 is connected to a voltage supply 53. The nodes 55 and 57 are connected to the input terminals of an amplifier 59 which provides at its output 61 a signal corresponding to the difference in the voltages at the anodes 55 and 57. As is well known, this difference is due to an imbalance in the resistances in the arms of the bridge 47. This imbalance results from tension changes in the thread 15 causing differences in the resistance of the strain gage 39. The resistance network 62 including the potentiometer 63 is for the purpose of balancing the system when there is no tension on the thread 15.

The output of the amplifier 55 over the lead 61 is applied through a low pass filter 64 to an analog to digital converter 65. The output of the analog to digital converter 65 is applied as an input to a microprocessor 67. The outputs of the optoelectronic timing sensors 29 and 31 are also applied as inputs to the microprocessor 67.

The microprocessor 67 utilizes the signals from the timing sensors 29 and 31 to define examination windows for the tension signal on the lead 69 from the analog to digital converter 65. The slit 33 in the timing disc 25 provides a reference for defining the beginning of the operating cycle of the stitch forming instrumentalities, defined as 0°. The slit 35 in the timing disc 27 provides a first examination window to define a "zero reference" for the thread tension. This measurement is obtained in order to compensate for possible thermal drift of the bridge, thereby reducing the need for expensive electrical components and/or highly stable DC amplifiers. The slit 37 in the timing disc 27 provides a second examination window for the first tension peak. During the second examination window, the microprocessor 67 examines the tension signal on the lead 69 and subtracts from this tension signal the zero reference determined during the first examination window. In particular, four such measurements are taken during the second examination window. The reason that four measurements are taken is that the tension profile shifts with machine speed and the multiple measurements insures that the tension peak will always be read. A skipped stitch is defined as the condition when all four of these measurements are less than a threshold value. Illustratively, this threshold value is defined as the voltage corresponding to approximately 5% of the stitch setting force (the magnitude of the second peak).

Based upon the foregoing, when the microprocessor 67 determines that a stitch has indeed been skipped, it executes a control function by providing a signal on the lead 71 to the utilization circuit 45. The utilization circuit 45 may take a variety of forms, none of which is considered limiting of this invention. For example, the utilization circuit 45 may provide an audible and/or visual alarm to the operator. Alternatively, the utilization circuit 45 may control a marking device which marks the work fabric in the vicinity of the skipped stitch with either a machine recognizable mark or a visually detectable mark. It also may provide a count of skipped stitches and the location of the first skipped stitch in terms of the number of stitches from some reference.

Accordingly, there has been disclosed an arrangement for incorporation in a sewing machine which provides the capability of detecting a skipped stitch as it occurs. It is understood that the above-described embodiment is merely illustrative of the application of the principles of this invention. Numerous other embodiments may be devised by those skilled in the art without departing from the spirit and scope of this invention, as defined by the appended claims.

I claim:

1. In a sewing machine having a support for work fabric to be stitched, cyclically operating stitch forming instrumentalities including a thread carrying needle adapted for endwise reciprocation to penetrate the fabric, a supply of thread for said needle, and a thread handling system including a tension control system for the thread disposed intermediate said supply and said needle, a skipped stitch detection system comprising:

sensing means disposed intermediate said tension control means and said needle and responsive to thread tension for supplying a tension signal, the instantaneous value of which corresponds to the thread tension at the sensing means position, the value of said tension signal having a first cyclic profile corresponding to a normal stitch and a second cyclic profile corresponding to a skipped stitch;

timing means for providing timing signals at predetermined times relative to the operating cycle of said stitch forming instrumentalities;

means responsive to said timing signals for defining examination windows for said tension signal; and means for examining said tension signal within said examination windows and responsive to values of said tension signal corresponding to said second cyclic profile for executing a control function.

2. A system according to claim 1 wherein said stitch forming instrumentalities include a thread take up lever disposed intermediate said tension control system and said needle; said sewing machine further includes a slack thread regulator disposed intermediate said tension control system and said take up lever; and said sensing means is mounted on said slack thread regulator.

3. The system according to claim 2 wherein said sensing means includes a strain gage.

4. The system according to claim 3 wherein said strain gage is connected as an arm of a Wheatstone bridge.

5. The system according to claim 1 wherein the needle bottom dead center position corresponds to 0° and 360° of a 360° operating cycle of the sewing machine stitch forming instrumentalities; the cyclic profile of the thread tension value for a normal stitch having a first peak within the range of 135° to 180° of the operating cycle and a second peak with the range of 180° to 360° of the operating cycle; the cyclic profile of the thread tension value for a skipped stitch having a single peak within the range of 180° and 360° of the operating cycle; and said examining means is responsive to the tension signal being below a predetermined threshold value within the range of 135° to 180° of the operating cycle for executing said control function.

6. The system according to claim 5 wherein the cyclic profiles of the thread tension values for normal and skipped stitches includes a region of low tension and said examining means utilizes the tension signal within said region to set a reference level.

7. The system according to claim 5 wherein said examining means is operative a plurality of times within the range of 135° to 180° of the operating cycle so as to compensate for shifts in the thread tension profile.

* * * * *